US011390098B2

(12) United States Patent
Yasumoto et al.

(10) Patent No.: US 11,390,098 B2
(45) Date of Patent: Jul. 19, 2022

(54) NAIL PRINTER

(71) Applicant: Funai Electric Co., Ltd., Osaka (JP)

(72) Inventors: Atsushi Yasumoto, Osaka (JP); Toshirou Tani, Osaka (JP)

(73) Assignee: FUNAI ELECTRIC CO., LTD., Osaka (JP)

( * ) Notice: Subject to any disclaimer, the term of this patent is extended or adjusted under 35 U.S.C. 154(b) by 499 days.

(21) Appl. No.: 16/549,378

(22) Filed: Aug. 23, 2019

(65) Prior Publication Data

US 2020/0060407 A1 Feb. 27, 2020

(30) Foreign Application Priority Data

Aug. 27, 2018 (JP) ..... JP2018-157892

(51) Int. Cl.

| | |
|---|---|
| ***B41J 3/407*** | (2006.01) |
| ***A45D 29/00*** | (2006.01) |
| ***B41J 29/02*** | (2006.01) |
| ***A45D 29/22*** | (2006.01) |

(52) U.S. Cl.

CPC ..... *B41J 29/023* (2013.01); *A45D 29/00* (2013.01); *A45D 29/22* (2013.01); *B41J 3/407* (2013.01); *A45D 2029/005* (2013.01); *B41J 3/40731* (2020.08)

(58) Field of Classification Search

CPC ..... B41J 29/023; B41J 3/40731; B41J 3/407; A45D 2029/005; A45D 29/00; A45D 29/22

See application file for complete search history.

(56) References Cited

U.S. PATENT DOCUMENTS

| | | | | |
|---|---|---|---|---|
| 2013/0235137 | A1* | 9/2013 | Nakayama | B41J 11/00224 347/102 |
| 2014/0232802 | A1* | 8/2014 | Bitoh | B41J 2/2117 347/110 |
| 2017/0273433 | A1* | 9/2017 | Hori | A45D 34/04 |
| 2018/0361736 | A1* | 12/2018 | Irie | A45D 29/00 |

FOREIGN PATENT DOCUMENTS

| | | |
|---|---|---|
| CN | 204743005 U | 11/2015 |
| JP | 2000-194938 A | 7/2000 |

* cited by examiner

*Primary Examiner* — Yaovi M Ameh

(74) *Attorney, Agent, or Firm* — Global IP Counselors, LLP

(57) ABSTRACT

A nail printer is a nail printer for printing on a nail of a finger. The nail printer includes a housing and a printer component. The housing includes a front face and a back face. The housing has an opening on the front face for inserting the finger in a specific direction and a pair of slanted wall portions that are disposed on both sides of the opening. The slanted wall portions are inclined downward with respect to the specific direction from the front face to the back face. The printer component is disposed inside the housing. The printer component performs printing on the nail of the finger disposed inside the housing through the opening.

19 Claims, 8 Drawing Sheets

NAIL PRINTER

CROSS-REFERENCE TO RELATED APPLICATIONS

This application claims priority to Japanese Patent Application No. 2018-157892 filed on Aug. 27, 2018. The entire disclosure of Japanese Patent Application No. 2018-157892 is hereby incorporated herein by reference.

BACKGROUND

Field of the Invention

The present invention generally relates to a nail printer for printing on a nail of a finger.

Background Information

Generally, a nail printer applies a manicure by printing on the nails of the fingers of the user's hand (see Japanese Patent Application Publication No. 2000-194938 (Patent Literature 1), for example). The nail printer comprises a housing and a print head that is disposed inside the housing. An opening for inserting a finger is formed in the front face of the housing. The print head discharges ink toward the nail of the finger disposed inside the housing through the opening while moving in two-dimensionally inside the housing.

The user inserts his or her five fingers into the opening of the housing one at a time, for example, and the nails of the five fingers are printed with colors, patterns, or the like.

SUMMARY

With the conventional nail printer described above, when the user has a finger inserted into the opening of the housing, if another nail of another finger that has already been printed but is not yet dry should come into contact with the front face of the housing, there is a risk that the printing applied to that nail of the finger may be rubbed off. Accordingly, the user must keep his or her fingers tightly bent so that the nails of the fingers not inserted into the opening of the housing will not touch the front face of the housing.

However, having to keep tightly bent those fingers that are not inserted into the opening of the housing is a problem in that it imposes a significant physical burden on the user.

One object is to provide a nail printer with which there is less physical burden on the user during printing.

In view of the state of the known technology and in accordance with one aspect, a nail printer is a nail printer for printing on a nail of a finger. The nail printer includes a housing and a printer component. The housing includes a front face and a back face. The housing has an opening on the front face for inserting the finger in a specific direction and a pair of slanted wall portions that are disposed on both sides of the opening. The slanted wall portions are inclined downward with respect to the specific direction from the front face to the back face. The printer component is disposed inside the housing. The printer component performs printing on the nail of the finger disposed inside the housing through the opening.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents. Specifically, all of the embodiments described below are general or specific examples. The numerical values, shapes, materials, constituent elements, layout positions and connection modes of the constituent elements, and so forth given in the following embodiments are all just examples, and are not intended to limit the present invention. Of the constituent elements in the following embodiments, those not mentioned in an independent claim will be described as optional constituent elements.

First Embodiment 1-1. Configuration of Nail Printer

Figure 1:
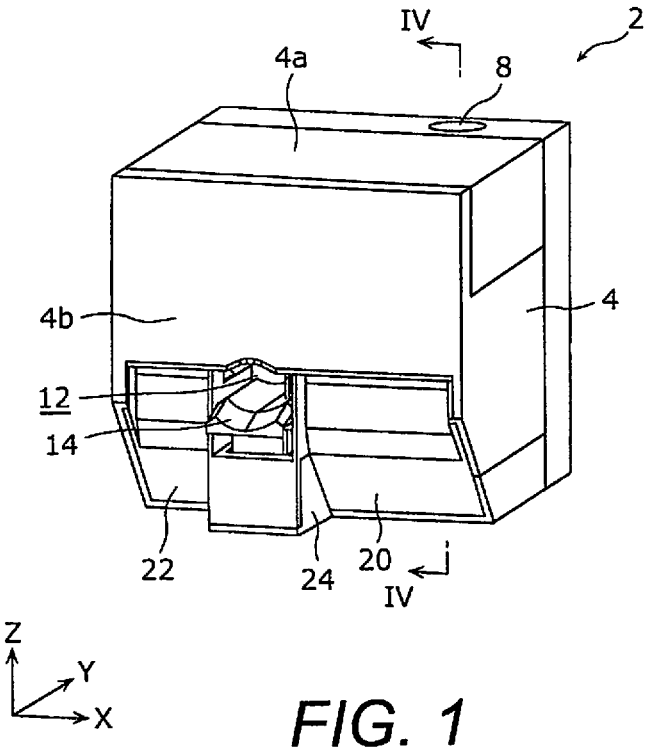
FIG. 1 is a front perspective view of a nail printer according to a first embodiment.
Figure 2:
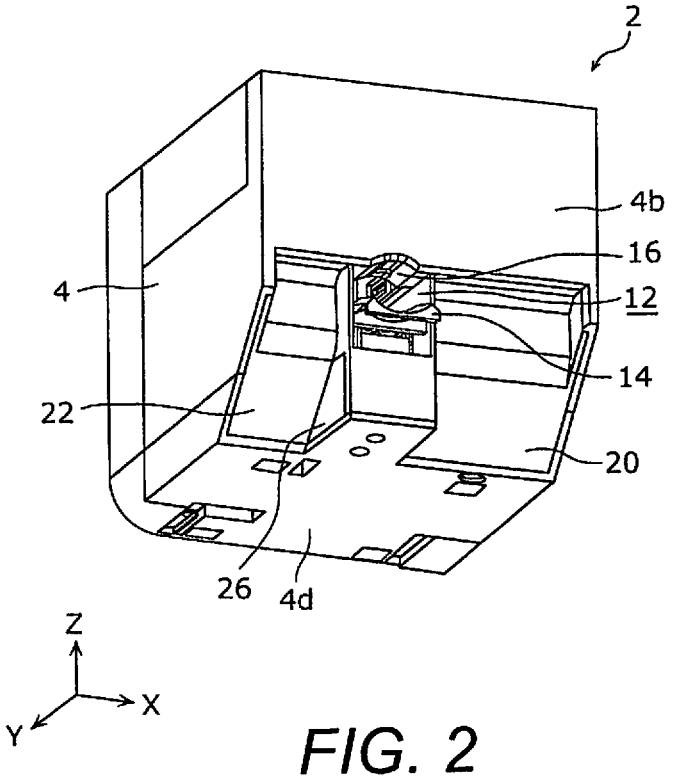
FIG. 2 is a front perspective view of the nail printer according to the first embodiment as viewed from a different angle from that in FIG. 1.
Figure 3:
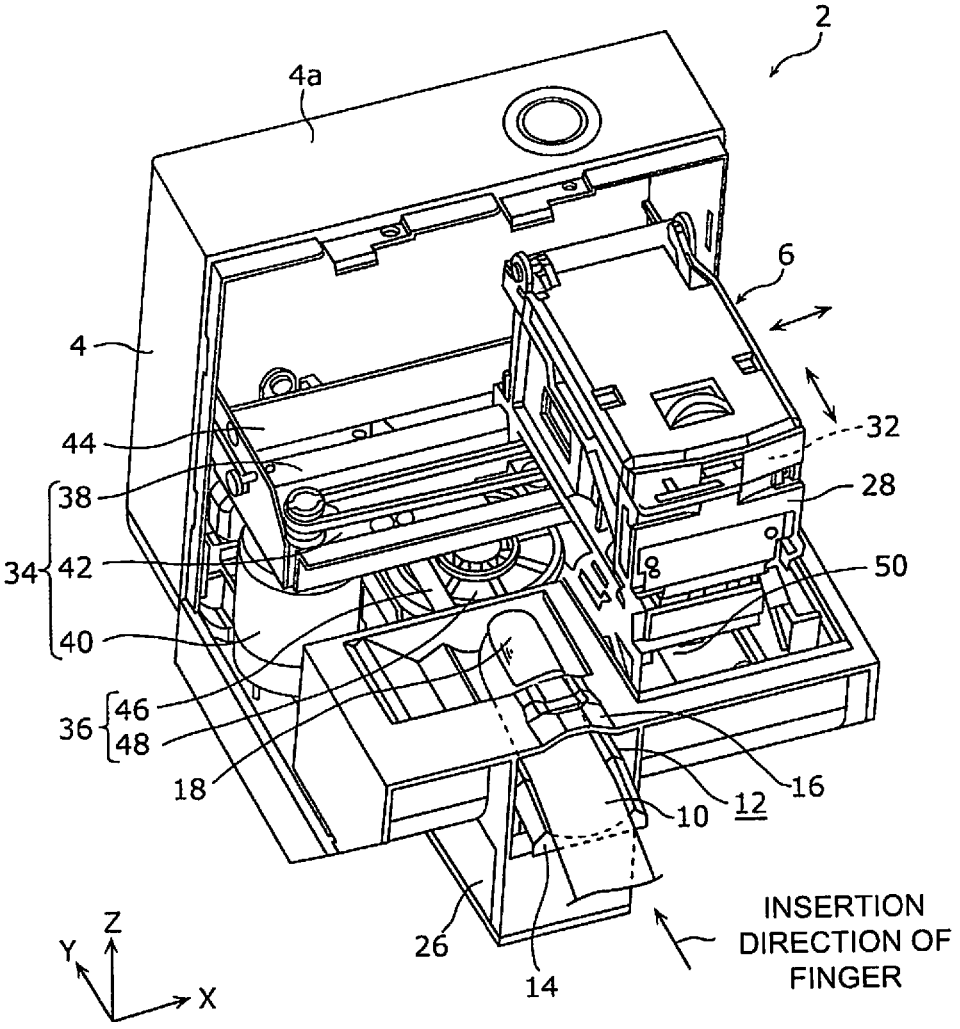
FIG. 3 is a front perspective view of the internal structure of the nail printer according to the first embodiment in a state in which part of a housing has been removed.
Figure 4:
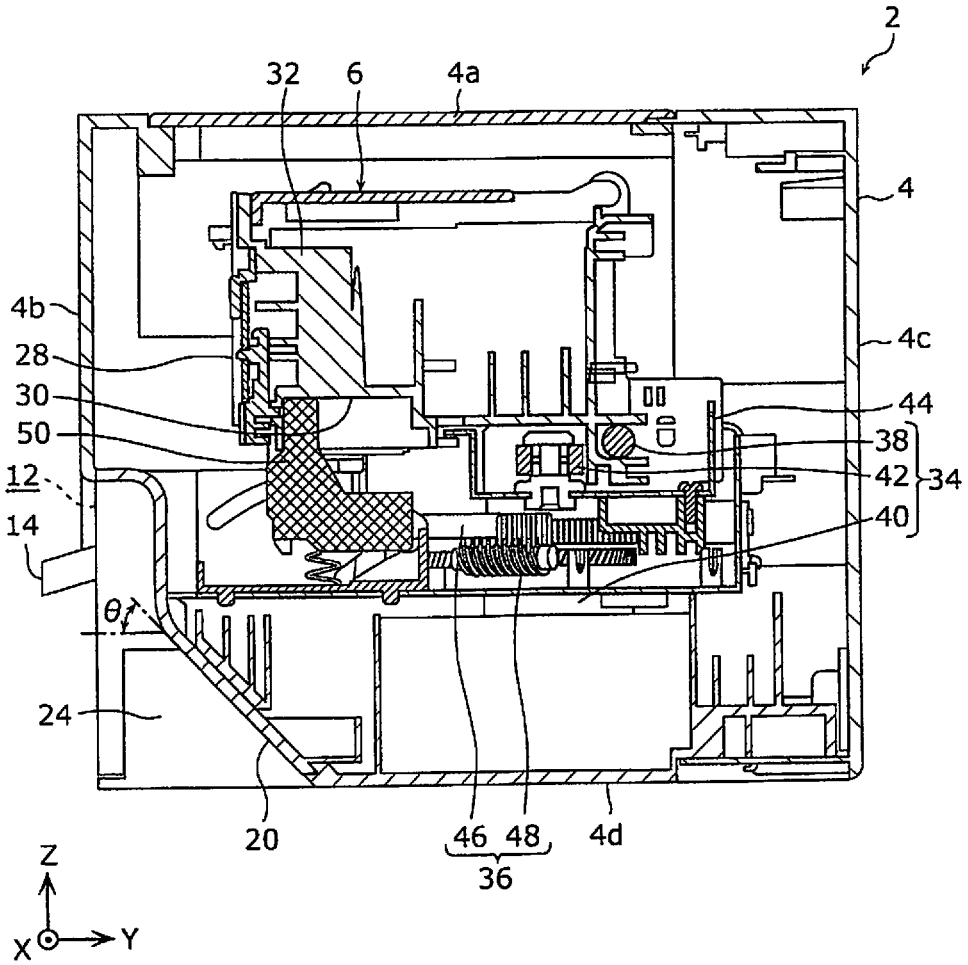
FIG. 4 is a cross sectional view of the nail printer according to the first embodiment, taken along IV-IV line in FIG. 1.

First, the configuration of a nail printer 2 according to a first embodiment will be described with reference to FIGS. 1 to 4. FIG. 1 is a front perspective view of the nail printer 2 according to the first embodiment. FIG. 2 is a first perspective view of the nail printer 2 according to the first embodiment as viewed from a different angle from that in FIG. 1. FIG. 3 is a front perspective view of the internal structure of the nail printer 2 according to the first embodiment in a state in which part of a housing 4 has been removed. FIG. 4 is a cross sectional view of the nail printer 2 according to the first embodiment, taken along IV-IV line in FIG. 1.

As shown in FIGS. 1 to 4, the nail printer 2 comprises the housing 4 and a printing component 6 (e.g., printer component). The nail printer 2 can communicate wirelessly with an external terminal (not shown) such as a smartphone. The user can operate the nail printer 2 by using an application installed on the external terminal as a user interface.

As shown in FIGS. 1, 2, and 4, the housing 4 is made of plastic, for example, and is formed in a box shape. As shown in FIGS. 1 and 3, a power switch 8 for turning the nail printer 2 on and off is disposed on the top face 4*a* of the housing 4.

As shown in FIGS. 1 to 3, an opening 12 for inserting a finger 10 (see FIG. 3) of the user's hand in a specific direction (the positive direction of the Y axis) is disposed on the front face 4*b* of the housing 4. As shown in FIG. 3, a placement plate 14 is disposed below the opening 12 (the negative side of the Z axis), and a hold-down plate 16 is disposed above the opening 12 (the positive side of the Z axis). The placement plate 14 is movable in the up and down direction (e.g., a vertical direction) with respect to the opening 12 and is biased by a spring (not shown) in the direction of moving closer to the hold-down plate 16. The placement plate 14 and the hold-down plate 16 define the opening 12 therebetween. The placement plate 14 is movable with respect to the hold-down plate 16. The placement plate 14 is biased toward the hold-down plate 16.

As shown in FIG. 3, the user inserts the finger 10 into the opening 12 of the housing 4 with the finger 10 extended straight so that the nail 18 of the finger 10 is facing up, and places the pad side of the finger 10 on the placement plate 14. The insertion direction of the finger 10 is the direction from the front face 4*b* of the housing 4 toward the back face 4*c* (the face on the opposite side from the front face 4*b*) (see FIG. 4). Consequently, a portion of the finger 10 that includes the nail 18 (for example, the portion from the tip of the finger 10 to near the first knuckle) is disposed inside the housing 4. At this point, the placement plate 14 is biased toward the hold-down plate 16 so that the area near the first knuckle of the finger 10 is squeezed from above and below by the placement plate 14 and the hold-down plate 16, for example. Thus, the placement plate 14 and the hold-down plate 16 vertically sandwich the finger 10 while the finger 10 is disposed inside the housing 4 through the opening 12.

The nail 18 of the finger 10 disposed inside the housing 4 is imaged by an imaging device (not shown) disposed above the nail 18. The image data for the nail 18 captured by the imaging device is wirelessly transmitted to an external terminal and displayed on the display unit of that external terminal. The user adjusts the position of the nail 18 of the finger 10 with respect to the placement plate 14 while looking at the image data for the nail 18 displayed on the display unit of the external terminal.

As shown in FIGS. 1 and 2, a pair of slanted wall portions 20 and 22 (or slanted outer walls) are disposed on either side of the opening 12 of the housing 4 in the left and right direction (the X axis direction or horizontal direction). As shown in FIG. 4, each of the pair of slanted wall portions 20 and 22 is disposed at a position slightly more to the back face 4*c* side than the front face 4*b* of the housing 4, and slants obliquely downward with respect to the insertion direction (the Y axis direction) of the finger 10, facing from the front face 4*b* toward the back face 4*c* of the housing 4. The inclination angle θ of the slanted wall portions 20 and 22 with respect to the insertion direction of the finger 10 is less than 90°, and is 45°, for example. Each lower end of the pair of slanted wall portions 20 and 22 extends to near the bottom face 4*d* of the housing 4.

In this embodiment, the lateral width (the width in the X axis direction) of the slanted wall portion 20 is greater than the lateral width of the slanted wall portion 22, but this is not the only option. The lateral width of the slanted wall portion 20 may be less than the lateral width of the slanted wall portion 22, or the lateral width of the slanted wall portion 20 and the lateral width of the slanted wall portion 22 may be the same.

Also, in this embodiment, the slanted wall portions 20 and 22 are each formed in a flat shape, but this is not the only option, and they may instead be formed in a curved shape, for example.

Also, as shown in FIGS. 1, 2, and 4, a pair of side walls 24 and 26 is disposed between the opening 12 of the housing 4 and the pair of slanted wall portions 20 and 22, respectively. The side walls 24 and 26 respectively extend downward (in the negative direction of the Z axis) from both sides in the left and right direction of the opening 12, and project more to the outside of the housing 4 (in the negative direction of the Y axis) than the slanted wall portions 20 and 22.

As shown in FIGS. 3 and 4, the printing component 6 is a printing unit or printer for performing a manicure by printing colors, patterns, or the like, for example, on the nail 18 of the finger 10 disposed inside the housing 4 through the opening 12 of the housing 4. In this embodiment, the printing method of the printing component 6 is an inkjet method in which printing is performed by spraying fine droplets of ink onto the nail 18 of the finger 10.

The printing component 6 is disposed movably inside the housing 4. The printing component 6 has a carriage 28 and a head 30 (see FIG. 4) disposed on the carriage 28. An ink cartridge 32 filled with various colors of ink is replaceably installed on the carriage 28. The head 30 discharges the ink supplied from the ink cartridge 32 downward.

As shown in FIGS. 3 and 4, the carriage 28 is movable in the X axis direction and the Y axis direction inside the housing 4 by an X axis drive mechanism 34 and a Y axis drive mechanism 36.

The X axis drive mechanism 34 has an X axis guide shaft 38, an X axis motor 40, and a timing belt 42. The X axis guide shaft 38 is supported by a scanning table 44 disposed inside the housing 4, and extends in a long, slender shape in the X axis direction (a direction substantially perpendicular to the insertion direction of the finger 10). The carriage 28 is movably supported by the X axis guide shaft 38. The X axis motor 40 is, for example, a servomotor, and is supported by the scanning table 44. The drive force of the X axis motor 40 is transmitted to the carriage 28 via the timing belt 42. Thus, the carriage 28 moves back and forth in the X axis direction along the X axis guide shaft 38 with respect to the scanning table 44.

The Y axis drive mechanism 36 has a Y axis guide shaft 46, a Y axis motor (not shown), and a gear unit 48. The Y axis guide shaft 46 is supported by the housing 4 and extends in a long, slender shape in the Y axis direction (the insertion direction of the finger 10). The scanning table 44 is movably supported by the Y axis guide shaft 46. The Y axis motor is, for example, a servomotor, and is supported by the housing 4. The drive force of the Y axis motor is transmitted to the scanning table 44 via the gear unit 48. Thus, the scanning table 44 moves back and forth in the Y axis direction along the Y axis guide shaft 46 integrally with the carriage 28.

Printing is applied to the nail 18 of the finger 10 by discharging ink from the head 30 of the printing component 6 toward the nail 18 of the finger 10 in a state in which the carriage 28 is moving back and forth in the X axis direction while moving in the negative direction of the Y axis.

Also, as shown in FIGS. 3 and 4, a maintenance unit 50 for maintaining the head 30 of the printing component 6 is disposed inside the housing 4. The maintenance unit 50 cleans (wipes) and protects (caps) the head 30. The maintenance unit 50 is disposed near the slanted wall portion 20, and can move back and forth in the Y axis direction.

1-2. Nail Printer Usage Method

Figure 5:
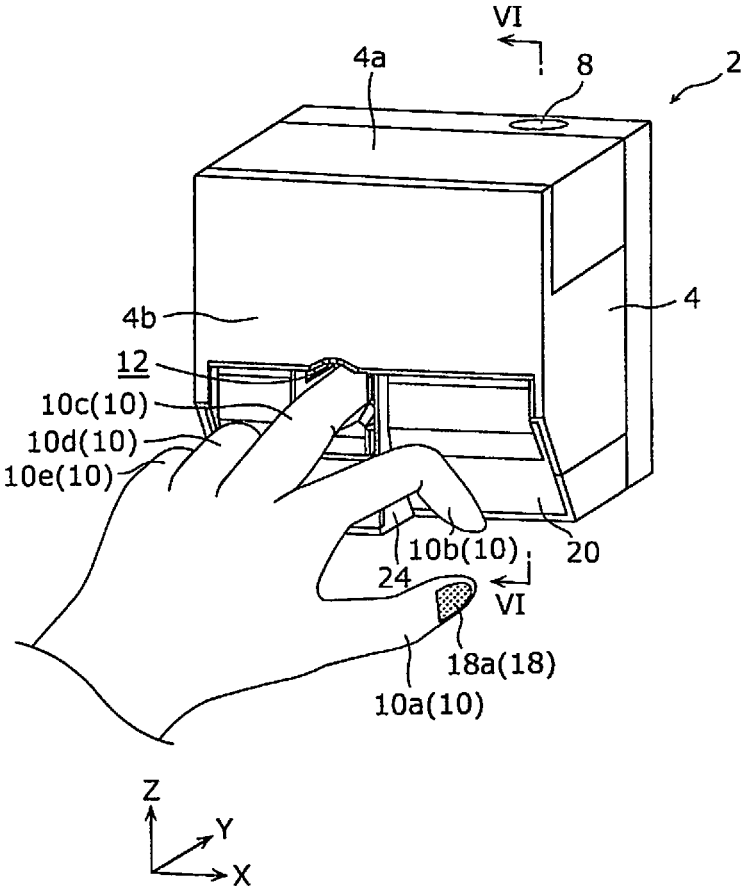
FIG. 5 is a front perspective view of the nail printer according to the first embodiment, illustrating a state in which the nail printer is being used.
Figure 6:
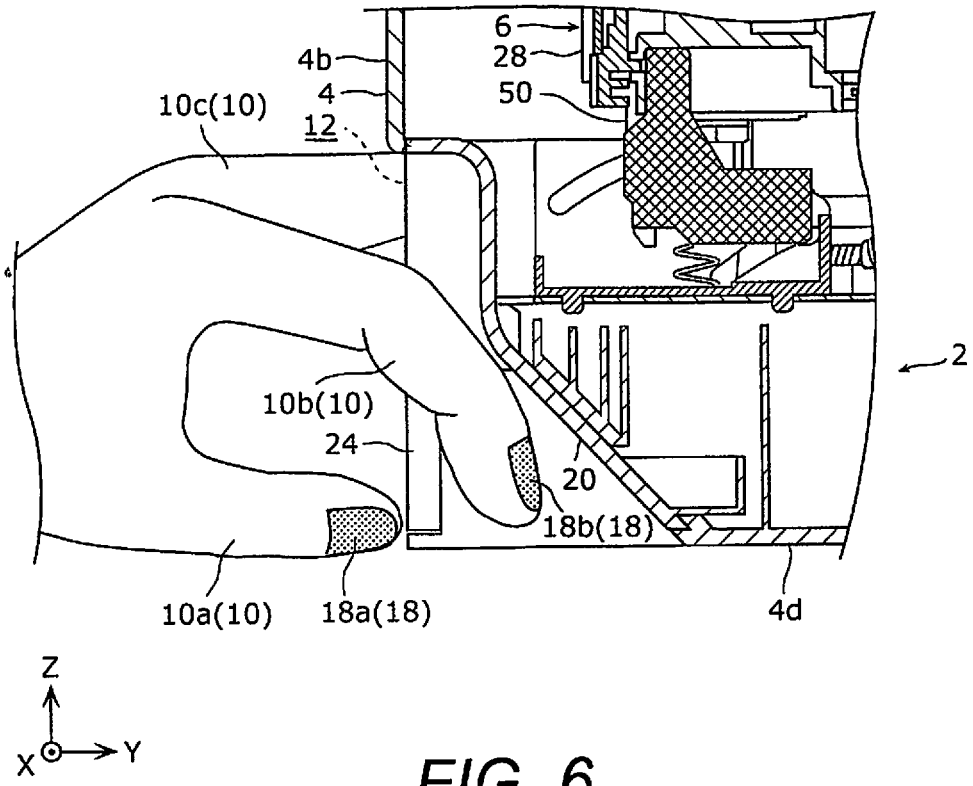
FIG. 6 is a cross sectional view of the main components of the nail printer according to the first embodiment, taken along VI-VI line in FIG. 5.

The method for using the nail printer 2 according to the first embodiment will now be described with reference to FIGS. 5 and 6. FIG. 5 is a front perspective view of the nail printer 2, illustrating how the nail printer 2 according to the first embodiment is used. FIG. 6 is a cross sectional view of the main components of the nail printer 2 according to the first embodiment, taken along VI-VI line in FIG. 5.

We will now describe, for example, a situation in which the five fingers of the left hand of the user (thumb 10*a*, forefinger 10*b*, middle finger 10*c*, ring finger 10*d*, and little finger 10*e*) are inserted in that order into the opening 12 of the housing 4 and sequentially printed on the nails 18 of the five fingers by the nail printer 2 (see FIG. 3).

In the example shown in FIGS. 5 and 6, the user has inserted the middle finger 10*c* of the left hand into the opening 12 of the housing 4. Let us assume that at this point printing has already been performed by the nail printer 2 on the nail 18*a* of the thumb 10*a* and the nail 18*b* of the forefinger 10*b*.

As described above, the slanted wall portions 20 and 22 are disposed on either side in the left and right direction of the opening 12 of the housing 4. Consequently, as shown in FIGS. 5 and 6, the user can lightly extend the forefinger 10*b* that is not inserted into the opening 12 of the housing 4 along the slanted wall portion 20, and can also lightly extend the ring finger 10*d* and the little finger 10*e* that are not inserted into the opening 12 of the housing 4 along the slanted wall portion 22. At this point, even if the forefinger 10*b* is lightly extended, the nail 18*b* of the forefinger 10*b*, which has been printed but is not yet dry, will be unlikely to come into contact with the slanted wall portion 20, so there is little risk that the printing applied to the nail 18*b* of the forefinger 10*b* will be rubbed off.

Therefore, since the user does not have to keep the forefinger 10*b*, the ring finger 10*d*, and the little finger 10*e* which are not inserted into the opening 12 of the housing 4 in a firmly bent state, the physical burden of the user during printing can be reduced.

The user may squeeze the side wall portions 24 and 26 from both sides with the index finger 10*b* and the ring finger 10*d* in a state in which the middle finger 10*c* has been inserted into the opening 12 of the housing 4. This allows the orientation of the index finger 10*b* and the ring finger 10*d* to be made more stable.

Similarly, when the user inserts the thumb 10*a*, the index finger 10*b*, the ring finger 10*d*, or the little finger 10*e* (that is, a finger other than the middle finger 10*c*) into the opening 12 of the housing 4, the physical burden on the user during printing can be reduced just as described above.

1-3. Effect

As described above, with this embodiment, the slanted wall portions 20 and 22 are disposed on either side in the left and right direction of the opening 12 of the housing 4. Each of the slanted wall portions 20 and 22 is slanted obliquely downward with respect to the insertion direction of the finger 10 (Y axis direction), from the front face 4*b* to the back face 4*c* of the housing 4.

Consequently, the user can lightly extend the fingers 10 not inserted into the opening 12 of the housing 4 (such as the index finger 10*b*, the ring finger 10*d*, and the little finger 10*e* in the example shown in FIG. 5) along the slanted wall portion 20 (or the slanted wall portion 22). As a result, since the user does not have to maintain the fingers 10 in a firmly bent state, it is possible to reduce the physical burden on the user during printing.

Also, since each of the slanted wall portions 20 and 22 is inclined obliquely downward with respect to the insertion direction of the finger 10, space for disposing the maintenance unit 50 and so forth can be ensured near the slanted wall portion 20 (or the slanted wall portion 22). As a result, the nail printer 2 can be made more compact.

Second Embodiment 2-1. Configuration of Nail Printer

Figure 7:
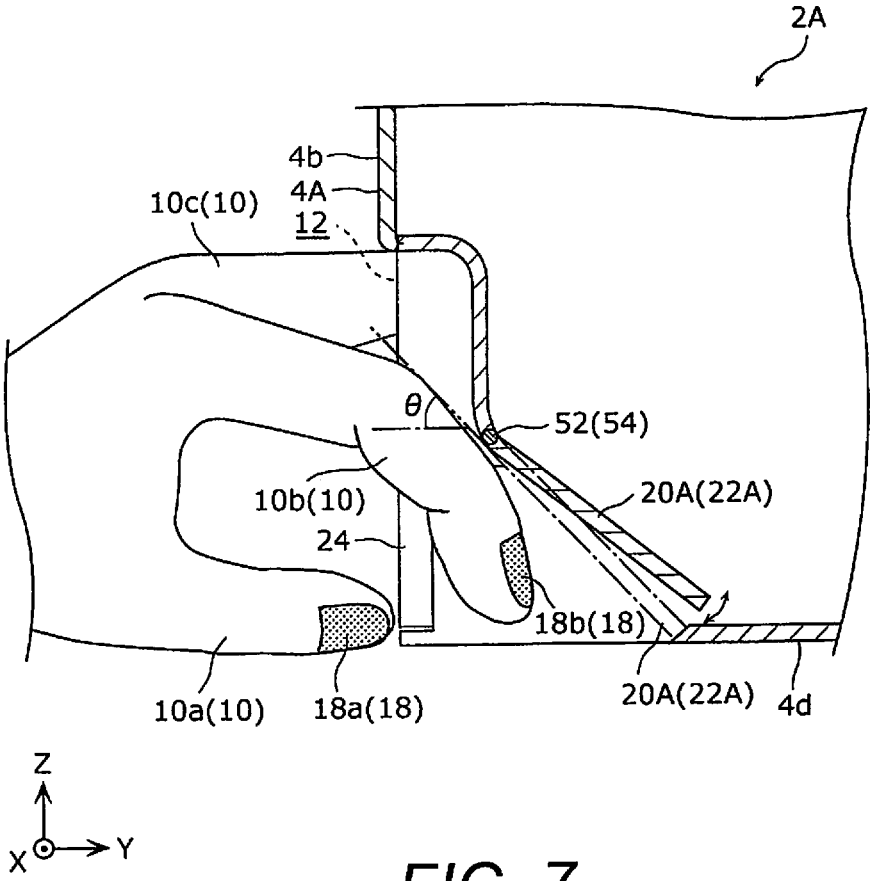
FIG. 7 is a cross sectional view of the main components of a nail printer according to a second embodiment.

The configuration of a nail printer 2A according to a second embodiment will be described with reference to FIG. 7. FIG. 7 is a cross sectional view of the main components of the nail printer 2A according to the second embodiment. For the sake of convenience, the internal structure of the nail printer 2A is not shown in FIG. 7. In the embodiments that follow, those components that are the same as in the first embodiment are numbered the same, and will not be described again.

As shown in FIG. 7, with the nail printer 2A in this embodiment, slanted wall portions 20A and 22A are slantably supported by the front face 4*b* of a housing 4A via hinges 52 and 54 (an example of a movable mechanism). The user can, for example, manually tilt the slanted wall portion 20A around the hinge 52 and can tilt the slanted wall portion 22A around the hinge 54. Thus, the hinges 52 and 54 pivotally support the slanted wall portions 20A and 22A with respect to the front face 4*b* of the housing 4A.

In this embodiment, the slanted wall portions 20A and 22A are each manually tilted, but this is not the only option. For example, the slanted walls 20A and 22A may be able to be tilted automatically by a dedicated motor (not shown) constituting a movable mechanism. Alternatively, for example, slanted wall portions 20A and 22A may be designed so that they can be automatically tilted in conjunction with the movement of the carriage 28 (see FIG. 3) in the Y axis direction.

2-2. Effect

In this embodiment, the inclination angle θ of the pair of slanted wall portions 20A and 22A with respect to a specific direction (the Y axis direction) can be varied as desired, according to the size of the user's hand, for example. As a result, when the user lightly extends those fingers 10 not inserted into the opening 12 of the housing 4A (such as the forefinger 10*b*) along the slanted wall portion 20A (or the slanted wall portion 22A), the nails 18 of those fingers 10 (such as the nail 18*b*) will be even less likely to come into contact with the slanted wall portion 20A (or the slanted wall portion 22A).

Third Embodiment 3-1. Configuration of Nail Printer

Figure 8:
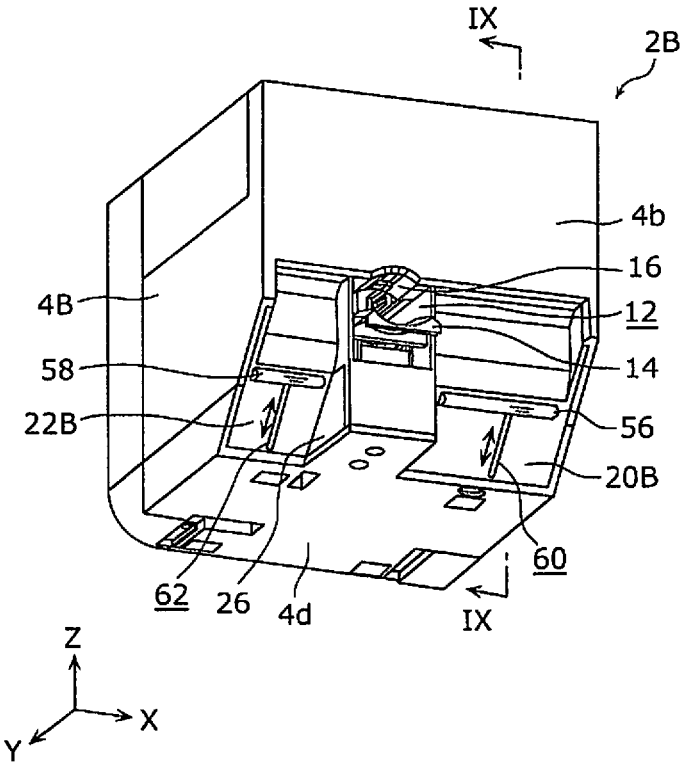
FIG. 8 is a front perspective view of a nail printer according to a third embodiment.
Figure 9:
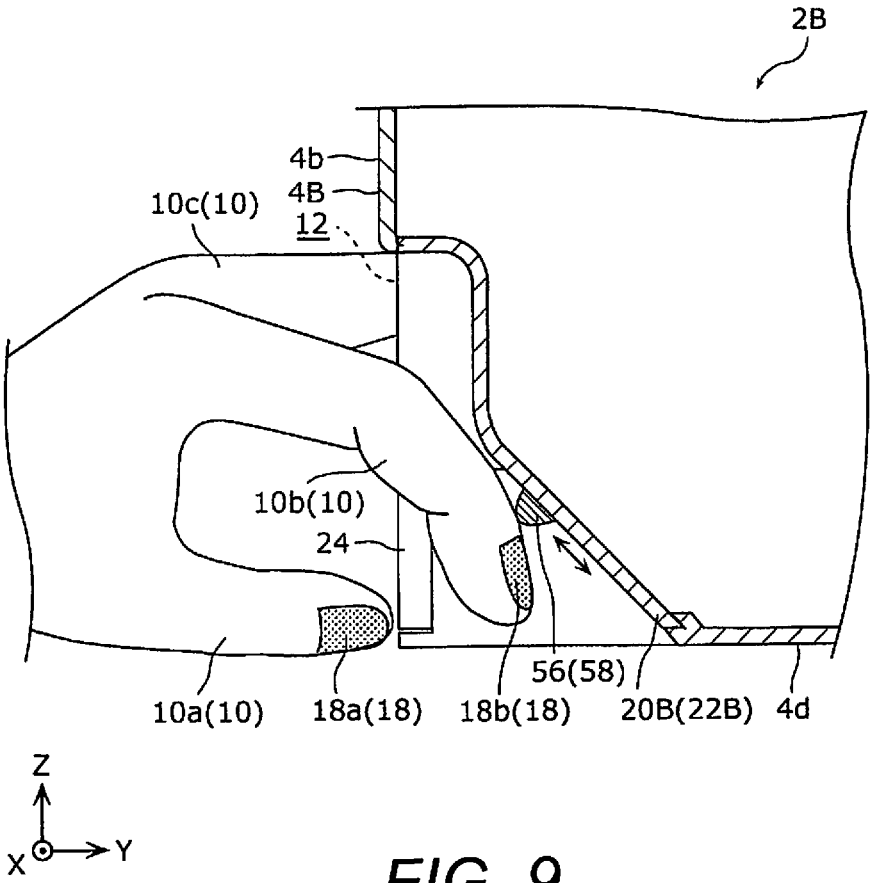
FIG. 9 is a cross sectional view of the main components of the nail printer according to the third embodiment, taken along IX-IX line in FIG. 8.

The configuration of a nail printer 2B according to a third embodiment will be described with reference to FIGS. 8 and 9. FIG. 8 is a front perspective view of the nail printer 2B according to the third embodiment. FIG. 9 is a cross sectional view of the main components of the nail printer 2B according to the third embodiment, taken along IX-IX line in FIG. 8. For the sake of convenience, the internal structure of the nail printer 2B is not shown in FIG. 9.

As shown in FIGS. 8 and 9, with the nail printer 2B in this embodiment, a housing 4B has a pair of projections 56 and 58 that respectively project from the slanted wall portions 20B and 22B toward the outside of the housing 4A. The projections 56 and 58 respectively extend in a long, slender shape in a direction (the X axis direction or horizontal direction) substantially perpendicular to the inclination directions of the slanted wall portions 20B and 22B. Thus, the projections 56 and 58 extend in the horizontal direction of the nail printer 2B along the slanted wall portions 20B and 22B, respectively.

Also, the projections 56 and 58 can slide along the respective inclination directions of the slanted wall portions 20B and 22B. More specifically, as shown in FIG. 8, the projection 56 is formed on the outer face of the slanted wall portion 20B, and is slidably fitted into a groove 60 extending in a long, slender shape along the inclination direction of the slanted wall portion 20B. The projection 58 is formed on the outer face of the slanted wall portion 22B, and is slidably fitted into a groove 62 extending in a long, slender shape along the inclination direction of the slanted wall portion 22B.

3-2. Effect

In this embodiment, as shown in FIG. 9, when a finger 10 not inserted into the opening 12 of the housing 4B (such as the index finger 10*b*) is lightly extended along the slanted wall portion 20B (or the slanted wall portion 22B), the back side of that finger 10 (near the first knuckle of the finger 10, for example) comes into contact with the projection 56 of the slanted wall 20B (or the projection 58 of the slanted wall 22B). Consequently, a gap is formed between the nail 18 of that finger 10 (such as the nail 18*b*) and the slanted wall portion 20B (or the slanted wall portion 22B), so the nail 18 of that finger 10 will be even less likely to touch the slanted wall portion 20B (or the slanted wall portion 22B).

Also, the positions of the projections 56 and 58 can be easily adjusted by sliding the projections 56 and 58 along the respective inclination directions of the pair of slanted wall portions 20B and 22B as dictated by the size of the user's hand and so forth, for example.

In this embodiment, the projections 56 and 58 are able to slide along the respective inclination directions of the slanted wall portions 20B and 22B, but the projections 56 and 58 may instead be fixed to the slanted wall portions 20B and 22B.

MODIFICATION EXAMPLES

The nail printers 2, 2A, and 2B according to the first to third embodiments of the present disclosure are described above, but the present invention is not limited to or by these embodiments. For example, the above embodiments may be combined with each other.

For instance, in the above embodiments, the printing method of the printing component 6 is inkjet, but this is not the only option, and another printing method may be adopted instead.

The present invention can be applied, for example, as a nail printer for printing on a nail of a finger.

In view of the state of the known technology and in accordance with one aspect, a nail printer is a nail printer for printing on a nail of a finger, the nail printer comprising a housing with a front face and a back face, the housing having an opening on the front face for inserting the finger in a specific direction and a pair of slanted wall portions that are disposed on both sides of the opening, the slanted wall portions being inclined downward with respect to the specific direction from the front face to the back face, and a printer component disposed inside the housing, the printer component performing printing on the nail of the finger disposed inside the housing through the opening.

With this aspect, since the slanted wall portions are disposed on either side of the opening of the housing, the user can lightly extend those fingers that are not inserted into the opening of the housing, along the slanted wall portions. As a result, the user does not have to keep those fingers that are not inserted into the opening of the housing tightly bent, so there is less physical burden on the user during printing.

In accordance with a preferred embodiment according to the nail printer mentioned above, the nail printer further comprises a movable mechanism changing an inclination angle of the slanted wall portions with respect to the specific direction.

With this aspect, the inclination angle of the slanted wall portions with respect to the specific direction can be varied as desired, according to the size of the user's hand, for example. As a result, when the user lightly extends those fingers not inserted into the opening of the housing along the slanted wall portions, the nails of those fingers will be less likely to come into contact with the slanted wall portions.

In accordance with a preferred embodiment according to any one of the nail printers mentioned above, the housing further has a pair of projections that respectively project from the slanted wall portions toward outside of the housing.

With this aspect, when the user lightly extends those fingers not inserted into the opening of the housing along the slanted wall portions, the back side of those fingers will hit the projection of the slanted wall portions. This makes it less likely that the nails of those fingers will touch the slanted wall portions.

In accordance with a preferred embodiment according to any one of the nail printers mentioned above, the projections are slidable along the slanted wall portions.

With this aspect, the positions of the projections can be easily adjusted by sliding the projections along the slanted wall portions according to the size of the user's hand, for example.

In accordance with a preferred embodiment according to any one of the nail printers mentioned above, the housing further has a pair of side walls that are respectively disposed between the opening and the slanted wall portions and that respectively project toward outside of the housing with respect to the slanted wall portions.

With this aspect, in a state in which the user has inserted a finger into the opening of the housing, another two fingers that are not inserted into the opening of the housing hold the side wall portions from both sides, and this allows these other two fingers to be kept more stably in the same orientation.

In accordance with a preferred embodiment according to any one of the nail printers mentioned above, the printer component has a carriage that is movably disposed inside the housing, and a head that is disposed on the carriage and discharges ink toward the nail of the finger.

With this aspect, inkjet printing can be performed on the nail of the finger.

The nail printer of the present disclosure reduces the physical burden on the user during printing.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts unless otherwise stated.

As used herein, the following directional terms "forward", "rearward", "front", "rear", "up", "down", "above", "below", "upward", "downward", "top", "bottom", "side", "vertical", "horizontal", "perpendicular" and "transverse" as well as any other similar directional terms refer to those directions of a nail printer in an upright position. Accordingly, these directional terms, as utilized to describe the nail printer should be interpreted relative to a nail printer in an upright position on a horizontal surface. The terms "left" and "right" are used to indicate the "right" when referencing from the right side as viewed from the front of the nail printer, and the "left" when referencing from the left side as viewed from the front of the nail printer.

The term "attached" or "attaching", as used herein, encompasses configurations in which an element is directly secured to another element by affixing the element directly to the other element; configurations in which the element is indirectly secured to the other element by affixing the element to the intermediate member(s) which in turn are affixed to the other element; and configurations in which one element is integral with another element, i.e. one element is essentially part of the other element. This definition also applies to words of similar meaning, for example, "joined", "connected", "coupled", "mounted", "bonded", "fixed" and their derivatives. Finally, terms of degree such as "substantially", "about" and "approximately" as used herein mean an amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, unless specifically stated otherwise, the size, shape, location or orientation of the various components can be changed as needed and/or desired so long as the changes do not substantially affect their intended function. Unless specifically stated otherwise, components that are shown directly connected or contacting each other can have intermediate structures disposed between them so long as the changes do not substantially affect their intended function. The functions of one element can be performed by two, and vice versa unless specifically stated otherwise. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A nail printer for printing on a nail of a finger, the nail printer comprising:

a housing with a front face and a back face, the housing having an opening on the front face for inserting the finger in a specific direction of the nail printer, a pair of slanted wall portions that are separately disposed on both sides of the opening such that the slanted wall portions are spaced apart from each other in a horizontal direction of the nail printer that intersects with the specific direction, the slanted wall portions being inclined downward with respect to the specific direction from the front face to the back face, and a pair of side walls that are respectively disposed between the opening and the slanted wall portions and that respectively project toward outside of the housing with respect to the slanted wall portions, the side walls being disposed between the slanted wall portions in the horizontal direction; and a printer component disposed inside the housing, the printer component performing printing on the nail of the finger disposed inside the housing through the opening.

2. The nail printer according to claim 1, further comprises a movable mechanism changing an inclination angle of the slanted wall portions with respect to the specific direction.

3. The nail printer according to claim 2, wherein the movable mechanism includes hinges that pivotally support the slanted wall portions with respect to the front face of the housing.

4. The nail printer according to claim 1, wherein the housing further has a pair of projections that respectively project from the slanted wall portions toward outside of the housing.

5. The nail printer according to claim 4, wherein the projections are slidable along the slanted wall portions.

6. The nail printer according to claim 4, wherein the slanted wall portions include grooves in which the projections are slidably fitted.

7. The nail printer according to claim 4, wherein the projections extend in the horizontal direction of the nail printer along the slanted wall portions, respectively.

8. The nail printer according to claim 4, wherein the projections are fixed to the slanted wall portions.

9. The nail printer according to claim 1, wherein the side walls extend perpendicular to the slanted wall portions, respectively.

10. The nail printer according to claim 1, wherein the opening is located between the side walls in the horizontal direction of the nail printer.

11. The nail printer according to claim 1, wherein the printer component has a carriage that is movably disposed inside the housing, and a head that is disposed on the carriage and discharges ink toward the nail of the finger.

12. The nail printer according to claim 1, wherein the printer component further has an ink cartridge replaceably provided to the carriage.

13. The nail printer according to claim 1, wherein an inclination angle of the slanted wall portions with respect to the specific direction is less than 90 degrees.

14. The nail printer according to claim 13, wherein the inclination angle of the slanted wall portions with respect to the specific direction is 45 degrees.

15. The nail printer according to claim 1, wherein the housing has a placement plate and a hold-down plate that defines the opening therebetween.

16. The nail printer according to claim 15, wherein the placement plate is movable with respect to the hold-down plate.

17. The nail printer according to claim 15, wherein the placement plate is biased toward the hold-down plate.

18. The nail printer according to claim 15, wherein the placement plate and the hold-down plate vertically sandwich the finger while the finger is disposed inside the housing through the opening.

19. The nail printer according to claim 1, wherein the slanted wall portions are a flat member.

* * * * *